US007878684B2

(12) United States Patent
Nauman

(10) Patent No.: US 7,878,684 B2
(45) Date of Patent: Feb. 1, 2011

(54) RETRACTABLE LIGHTING SYSTEM

(76) Inventor: Edward Nauman, 4611 Grandview Dr., Palmdale, CA (US) 93551

( * ) Notice: Subject to any disclaimer, the term of this patent is extended or adjusted under 35 U.S.C. 154(b) by 205 days.

(21) Appl. No.: 12/355,684

(22) Filed: Jan. 16, 2009

(65) Prior Publication Data

US 2009/0185375 A1 Jul. 23, 2009

Related U.S. Application Data

(60) Provisional application No. 61/022,220, filed on Jan. 18, 2008.

(51) Int. Cl.
*F21V 21/36* (2006.01)
*F21S 4/00* (2006.01)

(52) U.S. Cl. ..... 362/249.1; 362/249.16; 362/403

(58) Field of Classification Search ..... 362/35, 362/147, 151, 217.16, 233, 249.1, 249.14, 362/249.16, 403
See application file for complete search history.

(56) References Cited

U.S. PATENT DOCUMENTS

| | | | | |
|---|---|---|---|---|
| 3,569,691 | A * | 3/1971 | Tracy | 362/233 |
| 4,128,863 | A * | 12/1978 | Premetz | 362/249.01 |
| 5,003,442 | A * | 3/1991 | Gallo et al. | 362/233 |
| 2009/0113774 | A1 | 5/2009 | Kinzel et al. | |
| 2010/0110668 | A1 * | 5/2010 | Marlonia | 362/249.16 |

* cited by examiner

*Primary Examiner*—David V Bruce
(74) *Attorney, Agent, or Firm*—Christie, Parker & Hale, LLP

(57) ABSTRACT

A lighting system includes a rod rotatably mounted between a first support and a second support, and a light cord attached to the rod, the light cord including a plurality of light strings having a first end attached to the light cord and a second end free from the light cord. Each light string includes a plurality of lights. Each of the plurality of light strings have a use position in which the second end dangles from the rod and a stowed position in which each of the plurality of light strings are substantially wrapped around the rod. The lighting system further includes an activating mechanism for rotating the rod to transfer the plurality of light strings between the use position and the stowed position.

13 Claims, 3 Drawing Sheets

RETRACTABLE LIGHTING SYSTEM

CROSS REFERENCE TO RELATED APPLICATIONS

This application claims priority to and the benefit of U.S. Provisional Application No. 61/022,220, filed at the United States Patent and Trademark Office on Jan. 18, 2008, the entire content of which is incorporated herein by reference.

BACKGROUND

During festive and celebratory occasions, homeowners, business owners, and the public in general often incorporate a light display into a decorating scheme on the outside or inside of a building, room, shop, or other structure. However, typically the light display is not used throughout an entire year, and often, the light display may be used for a month or less. Accordingly, it is not desirable for the light display to be visible during the times when it is not used. Conventional light displays may have to be disassembled to remove the display from view and then may have to be reinstalled for reuse. Additionally, the light display may have to be packaged and stored in a safe place when it is not being used. Such disassembly, storage, and reinstallation of the light display is tedious, time consuming, and space consuming. Accordingly, there is a need for a lighting system that can be permanently installed, yet allows for lights to be displayed when desired and hidden from view during the rest of the year.

SUMMARY

A lighting system includes a rod rotatably mounted between a first support and a second support, and a light cord attached to the rod, the light cord including a plurality of light strings having a first end attached to the light cord and a second end free from the light cord. Each light string includes a plurality of lights. Each of the plurality of light strings have a use position in which the second end dangles from the rod and a stowed position in which each of the plurality of light strings are substantially wrapped around the rod. The lighting system further includes an activating mechanism for rotating the rod to transfer the plurality of light strings between the use position and the stowed position.

In one embodiment, the activation mechanism is a gear system. Further, each of the plurality of light strings may include a weight secured to the second end and may be attached to the rod by a plurality of fasteners, such as tie wraps. In another embodiment, the light cord may be attached to the rod by a sleeve. The rod may include a slot configured to receive the light cord for attaching the light cord to the rod.

Also provided is a method of displaying and stowing a plurality of lights in a light system including mounting a first support and a second support to a structure, attaching a plurality of light strings to a rod, each of the plurality of light strings comprising a plurality of lights, and rotatably mounting the rod between a first support and a second support such that the rod can be rotated to allow each of the plurality of light strings to dangle from the rod and to wind each of the plurality of light strings to be substantially wound around the rod.

DETAILED DESCRIPTION

A lighting system 10 is provided in accordance with embodiments of the present invention is provided to allow for a permanently mountable light display that may be alternated from being visible and substantially or completely hidden from view as desired. Accordingly, the lighting system may be permanently installed in a location, used as a display and then be hidden from view without being uninstalled and/or disassembled. More specifically, embodiments of the lighting system 10 include a mounting system for securely attaching the lighting system in a desired location and an activation mechanism for transferring lights between a use position in which the lights are visible and a stowed position in which the lights are hidden or less conspicuous. Further, embodiments of the lighting system provide a system in which light strings are not easily tangled upon retraction of the lights from the use position to the stowed position and upon unraveling of the lights from the stowed position to the use position.

In general, embodiments of the lighting system of the present invention are directed to light displays for hanging or dangling light strings. As such, the lighting system will generally be installed in a location that allows the light strings to dangle from a mounting assembly attached to a rigid surface.

Figure 1:
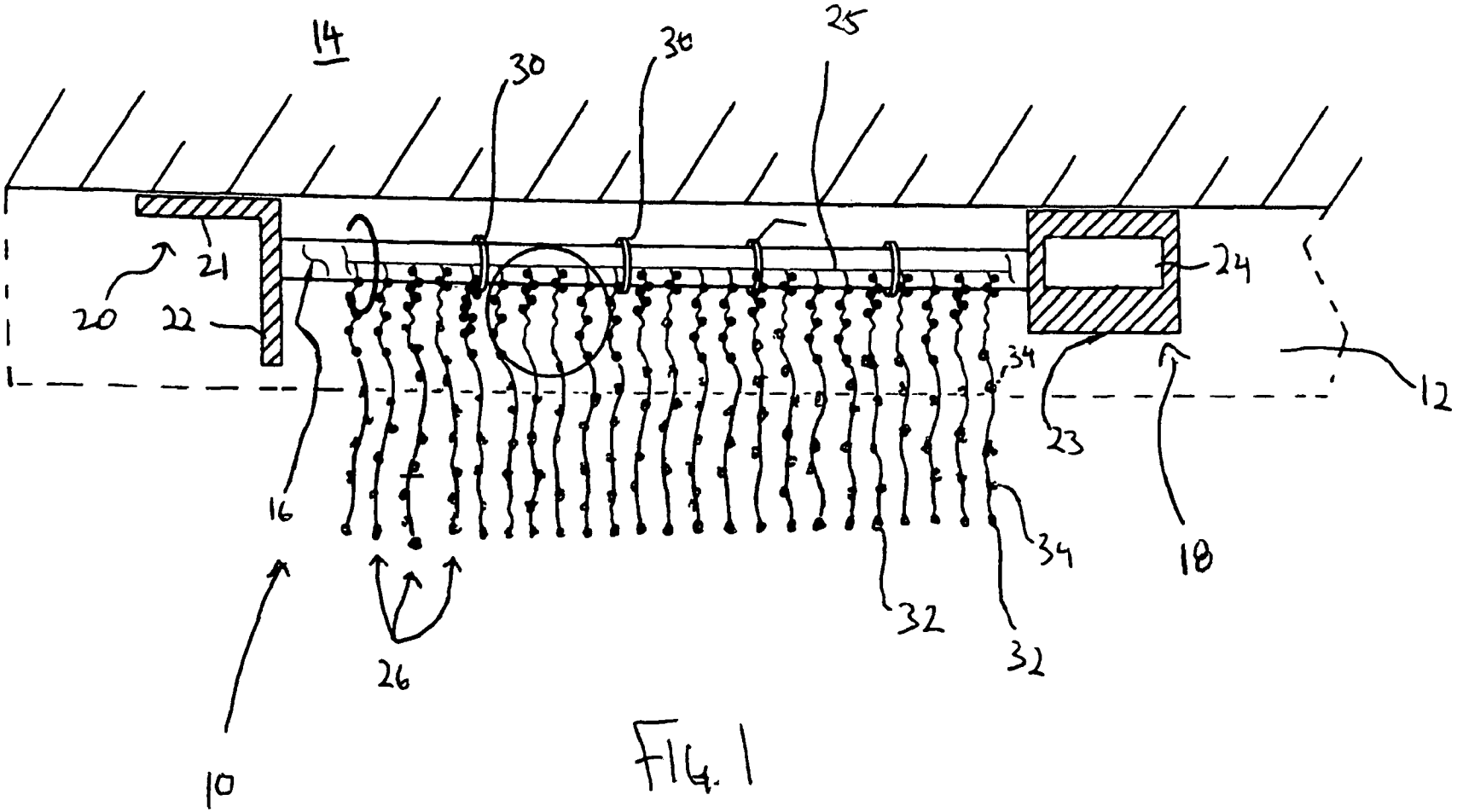
FIG. 1 is a partially schematic side view of a lighting system in a use position according to an exemplary embodiment of the present invention.

As shown in FIG. 1, in one exemplary embodiment of the present invention the lighting system 10 is mounted on a fascia board overhang 12 extending from a roof 14 of a building, such as a residence, such that light strings 26 of the light display can dangle in the use position. As will be appreciated by one of ordinary skill in the art, the lighting system 10 is adapted to be mounted on a variety of structures on either the exterior or the interior thereof, if desired, and is not limited to being used in connection with an overhang. However, in the present exemplary embodiment, the overhang 12 may be used to better conceal the lighting system 10 such that the lighting system is well hidden in the stowed position, and further such that only the light strings 26, and not the other components of the lighting system, are visible in the use position.

A mount assembly for the lighting system 10 is provided to support the lighting system in a fixed and relatively permanent location and further to allow the lighting system to move between the use position and the stowed position.

In one embodiment, the mounting system comprises a plurality of supports, such as a first support 18 and a second support 20 as shown in FIG. 1, and a rod 16 rotatably extending between and attached to the supports. In the present embodiment, the first support 18 includes a housing 23 for housing an activation mechanism 24 for the light assembly. The housing 23 may be generally hexahedronal so as to substantially cover the activation mechanism 24 within the housing and the housing may also be configured to receive and support the rod 16. One of ordinary skill in the art will appreciate that the housing may have one of a variety of shapes and configurations within the scope of the present invention, or that the housing may be omitted entirely.

The activation mechanism 24 serves to move the lighting system between the use position and the stowed position by rotating the rod, as described in more detail below. The activation mechanism 24 may be connected to a power source for driving the activation mechanism. Nonlimiting examples of the activation mechanism 24 include a gear system, a pulley and chord, and a hand cranked gear drive. However, one of ordinary skill in the art will appreciate that other activation mechanisms 24 may be employed to move the lighting system between the use an stowed position within the spirit and scope of the present invention.

In the present embodiment, the second support 20 is a bracket configured to be attached to a structure and to receive the rod 16. More specifically, the second support 20 may be a substantially L-shaped structure having a first leg 21 attachable to a structure and a second leg generally perpendicular to the first leg defining an opening for receiving the rod. Although different specific types of supports 18, 20 are described with respect to FIG. 1, it will be appreciated that the same type of support may be used at both ends of the lighting system and that other types of supporting members, such as hooks, may be used. Further, depending on the length of the rod 16 and the amount of support needed, intermediate supports similar to the second support 20 may be placed along sections of the rod. Additionally, although an activation mechanism has been described, one of ordinary skill in the art will appreciate that the activation mechanism may be omitted and that movement between the use and stowed positions could be imparted manually, such as by hand-turning the rod 16. The first and second supports 18, 20 may be mounted to the overhang 12 and/or to the roof 14 by any suitable fastener, such as screws, nails, an adhesive, or a combination thereof.

As noted above, the rod 16 extends between the first and second supporting members 18, 20 and is rotatably attached to each supporting member. The rod 16 serves as a mounting base for a light cord 25 that supports a plurality of light strings 26, as described in more detail below. The rod 16 may be one integral piece or may comprise multiple rod sections attached together by a coupling and a fastener so as to extend a desired length. The rod 16 may comprise a generally rigid material such as aluminum, polyvinyl chloride (PVC), or other similar materials.

In one embodiment, multiple rods may be connected at an angle through an angle drive mechanism allowing the lighting system to extend around corners. The rods may be driven by the activation mechanism 24 as described above, thereby allowing a single activation mechanism to drive the lighting system for an entire room or area.

The light cord 25 is connectable to a power source, such as an electrical socket, and comprises a plurality of light strings 26 having one end attached to the light cord and configured to dangle from the light cord. Each light string 26 comprises a plurality of light bulbs 34 and is electrically connected to the light cord for powering the lights. The light bulbs 34, may be, for example, incandescent bulbs, light emitting diodes (LEDs), or neon bulbs. One of ordinary skill in the art will appreciate that the light strings 26 may be of a desired length and that the light strings may all be the same length or be of varying lengths.

Figure 3:
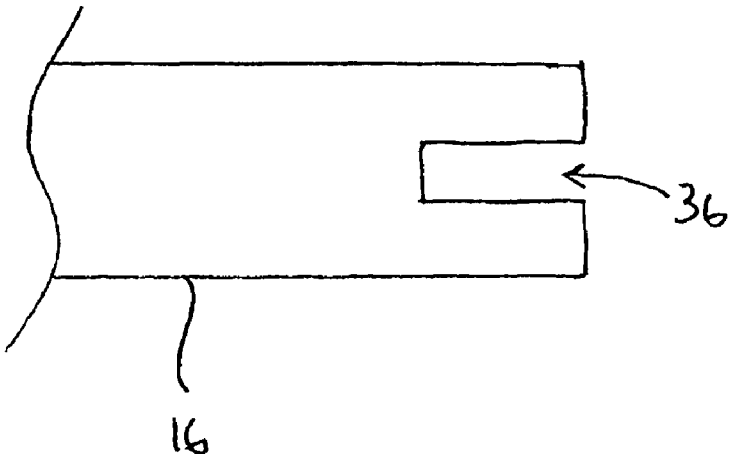
FIG. 3 is a detail view of an end of a rod according to an embodiment of the present invention.

With respect to FIG. 3, in one embodiment, an end of the rod 16 may include a slot 36 configured to receive the light cord 25 for securing an end of the light cord to the rod. As described in more detail below, a grommet, O-ring or other similar device may be used to secure the light cord 25 within the slot 36. However, it will be appreciated that ends of the light cord 25 may also be attached to a rod without a slot and also by other fasteners, such as an adhesive, tape, or the like.

Fasteners 30, such as band clamps or tie wraps, may be used to secure the central length of the light cord 25 to the rod 16, thereby allowing the light strings 26 to dangle from the rod when the rod is secured off the ground. In one exemplary embodiment, the fasteners 30 are evenly spaced along a length of the rod 16, although it will be appreciated that the fasteners could be spaced. Using removable fasteners 30 allows the light cord 25 to be loosened or removed entirely, thereby permitting modification of the light cord and allowing for additional light cords to be added, removed, and/or replaced, as desired. Additionally, the light strings 26 may be more permanently secured to the rod 16 without using the removable fasteners 30, such as by using an adhesive, staples, or any other suitable fastener.

Figure 4:
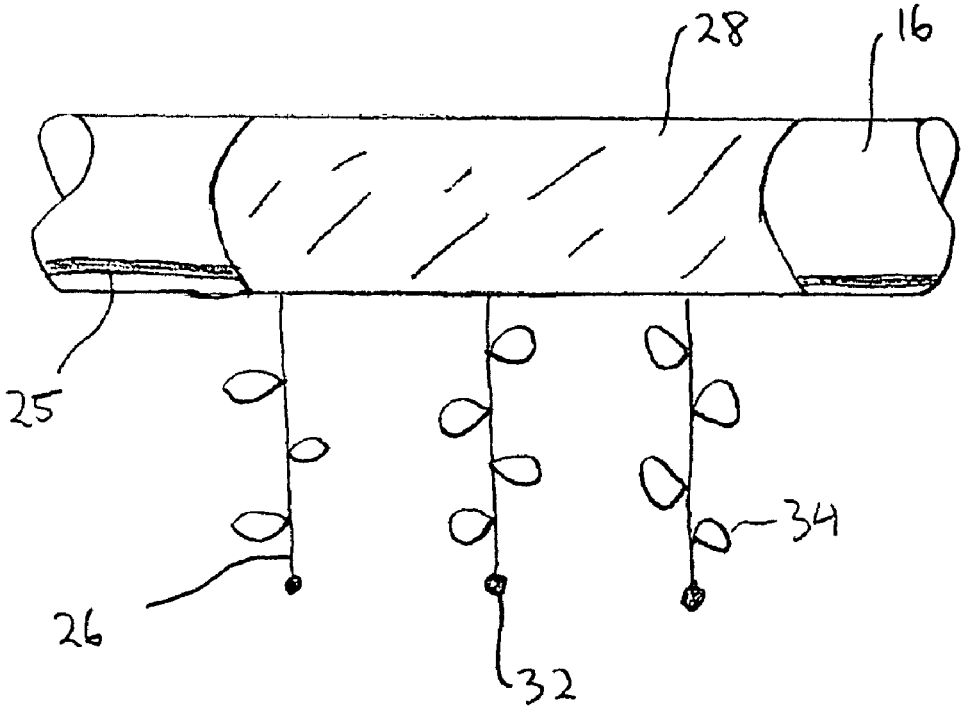
FIG. 4 is a schematic side view of an alternative embodiment of a lighting system of the present invention.

In another exemplary embodiment of the present invention as shown in FIG. 4, a sleeve 28 may be used to cover the light cord 25 and also to provide a more secure attachment of the light cord to the rod 16. The sleeve may define an opening for allowing the light strings 26 to protrude therefrom. In one embodiment, the sleeve may comprise a resilient material, such as rubber, and may be sized to fit onto the rod 16 to secure the light cord 25 thereto. However, the removable fasteners 30 may also be inserted over the sleeve 28 to attach the sleeve to the rod 16, or to provide a more permanent structure, the sleeve 28 may be glued, welded, or otherwise permanently secured to the rod 16 to cover the light cord 25.

With reference again to FIG. 1, in one exemplary embodiment, a weight 32 is secured to an unattached end of each light string 26 to bias the light string toward the ground. Accordingly, as the light strings 26 are wound or unraveled by the lighting system 10, as described in more detail below, the light strings are biased to remain generally orthogonal to a longitudinal axis of the rod 16, and therefore are less likely to tangle with each other. Additionally, the weight 32 will aid each light string 26 in unraveling even if there is some tangling among the lights 34 during winding. Further, in one exemplary embodiment, the lights strings 26 are all approximately the same length. As such, when the light strings 26 are wound, none of the light strings dangle to prevent concealment. The lights 34 attached to each light string 26 may be spaced at varied intervals on each light string, thereby providing the appearance of unique light string lengths. However, as one of skill in the art will appreciate, uniquely dimensioned light strings 26 may be used without departing from the spirit and scope of the present invention, and may still be wound such that all of the light strings are concealed.

Operation of the lighting system 10 will now be described. The lighting system 10 may be set up by installing the supports 18, 20 plus any necessary intermediate supports onto a structure and extending the rod 16 between the supports such that the rod is rotatably connected to the supports. An end of the light cord 25 can then be inserted into a slot 36 at either end of the rod and held in place by, for example a grommet or other fastener such that the light cord extends along a length of the rod.

As shown in FIG. 1, in the use position of the lighting system 10, the light strings 26 dangle from the rod 16 by a length such that they are exposed and can be seen from the ground or from wherever viewers are located with respect to the lighting system. Although the light strings 26 are shown dangling by their entire length, it will be appreciated that the light strings may also be partially wound around the rod 16 in the use position and still be visible.

Figure 2:
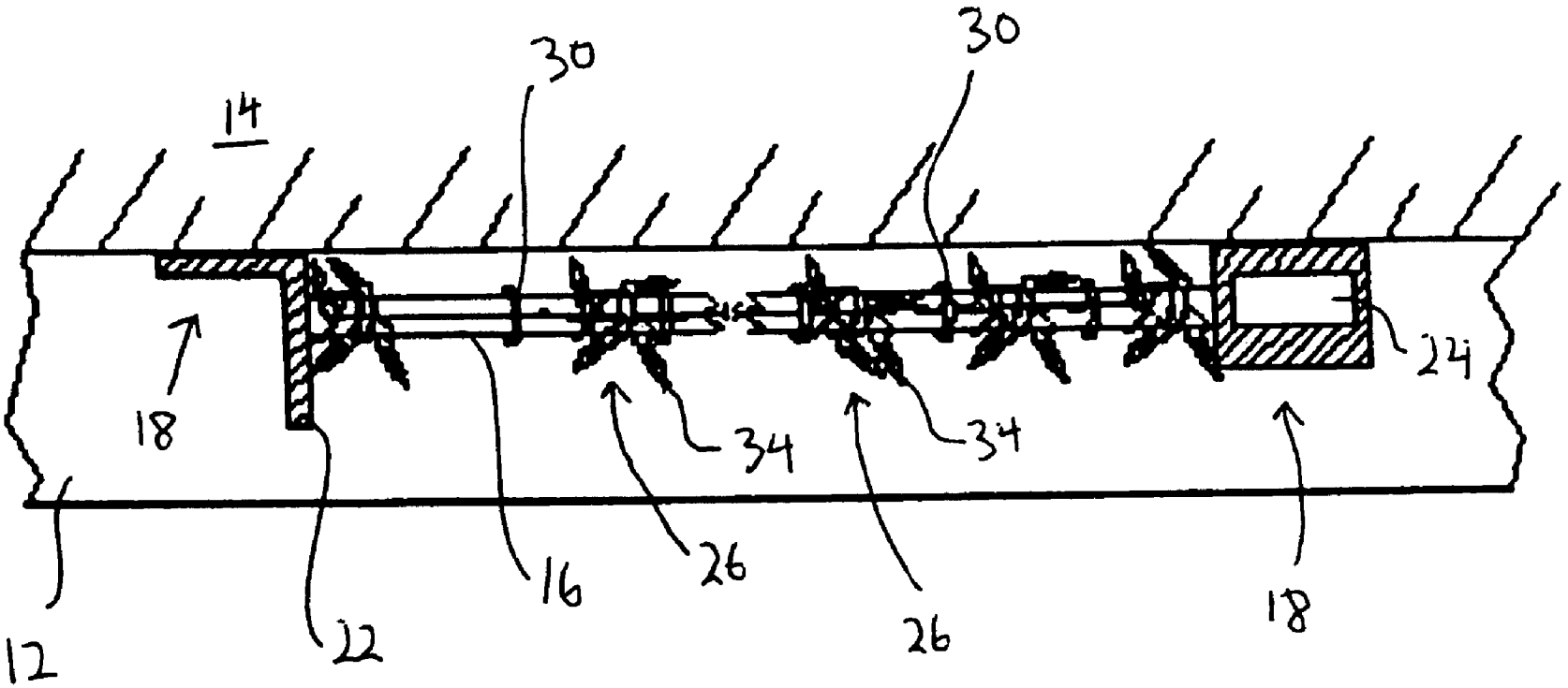
FIG. 2 is a partially schematic side view of the lighting system of FIG. 1 in a stowed position.

The lighting system 10 may be transferred between a use position (FIG. 1) and a stowed position (FIG. 2), in which the light strings 26 are wound around the rod 16, and are thereby substantially or entirely out of sight, particularly when hidden behind the fascia board 12 or another structure extending in front of the lighting system 10. To transfer the lighting system 10 from the use position to the stowed position, the activation mechanism is activated, causing the rod 16 to rotate in a first direction. Rotation of the rod 16 in the first direction results in the winding of each light string 26 around the rod, substantially preventing the light strings from dangling, but allowing the light strings to remain on the structure. As noted above, the weight 32 at an end of each light string 26 helps maintain the light string generally orthogonal to an axis of rotation, thereby preventing tangling of the light string. Accordingly, rather than having to be removed when not in use, the lighting system 10 can remain in place in the stowed position generally absent from view. To redisplay the light strings 26, the activation mechanism 24 is activated to rotate the rod in a second direction opposite to the first direction, thereby unraveling the light strings 26 to the use position. Again, the weight 32 biases the light string 26 to unravel generally orthogonally to the axis of rotation to prevent tangling.

Although limited lighting system embodiments have been specifically described and illustrated, many modifications, combinations, and variations of the embodiments will be apparent to those skilled in the art. For example, the light strings may be attached to the rod by many different fasteners and fastening methods to affect the same purpose within the scope and spirit of the present invention. Accordingly, it is to be understood that the lighting system constructed according to principles of this invention may be embodied other than as specifically described herein. The invention is also defined in the following claims.

What is claimed is:

1. A lighting system comprising:

a rod rotatably mounted between a first support and a second support;

a light cord attached to the rod, the light cord comprising a plurality of light strings having a first end attached to the light cord and a second end free from the light cord, each light string comprising a plurality of lights; wherein each of the plurality of light strings have a use position in which the second end dangles from the rod and a stowed position in which each of the plurality of light strings are substantially wrapped around the rod; and an activating mechanism for rotating the rod to transfer the plurality of light strings between the use position and the stowed position.

2. The lighting system of claim 1, wherein the activation mechanism is a gear system.

3. The lighting system of claim 1, wherein each of the plurality of light strings further comprise a weight secured to the second end.

4. The lighting system of claim 1, wherein the light cord is attached to the rod by a plurality of fasteners.

5. The lighting system of claim 4, wherein the fasteners are tie wraps.

6. The lighting system of claim 1, wherein the light cord is attached to the rod by a sleeve.

7. The lighting system of claim 1, wherein each of the plurality of light strings comprises a plurality of lights.

8. The lighting system of claim 1, wherein an end of the rod further comprises a slot configured to receive the light cord for attaching the light cord to the rod.

9. A method of displaying and stowing a plurality of lights in a light system comprising:

mounting a first support and a second support to a structure;

attaching a plurality of light strings to a rod, each of the plurality of light strings comprising a plurality of lights; and rotatably mounting the rod between a first support and a second support such that the rod can be rotated to allow each of the plurality of light strings to dangle from the rod and to wind each of the plurality of light strings to be substantially wound around the rod.

10. The method of claim 9, wherein the rod is rotated by a gear system.

11. The method of claim 9, wherein each of the plurality of light strings is attached to a light cord, the light cord being attached to the rod.

12. The method of claim 11, wherein the light cord is attached to the rod by fasteners.

13. The method of claim 11, wherein the light cord is attached to the rod by a sleeve.

* * * * *

UNITED STATES PATENT AND TRADEMARK OFFICE

CERTIFICATE OF CORRECTION

PATENT NO. : 7,878,684 B2
APPLICATION NO. : 12/355684
DATED : February 1, 2011
INVENTOR(S) : Edward Nauman It is certified that error appears in the above-identified patent and that said Letters Patent is hereby corrected as shown below:

On the Title Page

| | |
|---|---|
| (57) Abstract, line 6 | Delete "have" Insert -- has -- |
| (57) Abstract, line 9 | Delete "are" Insert -- is -- |

In the Claims

| | |
|---|---|
| Column 5, Claim 1, line 37 | Delete "have" Insert -- has -- |
| Column 5, Claim 1, line 39 | Delete "are" Insert -- is -- |

Signed and Sealed this
Eighteenth Day of October, 2011

David J. Kappos

David J. Kappos
*Director of the United States Patent and Trademark Office*